US007237756B2

(12) United States Patent
Isenberg

(10) Patent No.: US 7,237,756 B2
(45) Date of Patent: Jul. 3, 2007

(54) MANUAL SUPPORT FOR FOLDER OR BINDER AND CONTENTS THEREOF

(76) Inventor: Theodore A. Isenberg, 9409 W. St. Paul Ave., Milwaukee, WI (US) 53226

( * ) Notice: Subject to any disclaimer, the term of this patent is extended or adjusted under 35 U.S.C. 154(b) by 516 days.

(21) Appl. No.: 10/779,242

(22) Filed: Feb. 13, 2004

(65) Prior Publication Data

US 2005/0179248 A1 Aug. 18, 2005

(51) Int. Cl.
*B42D 3/00* (2006.01)

(52) U.S. Cl. ..... 248/451; 248/441.1; 248/448; 281/48

(58) Field of Classification Search ..... 248/218, 248/462, 446, 447, 460, 464; 281/45, 46, 281/48, 49
See application file for complete search history.

(56) References Cited

U.S. PATENT DOCUMENTS

| | | | | |
|---|---|---|---|---|
| 563,056 | A | 6/1896 | Parkes | |
| 825,072 | A | 7/1906 | Power et al. | |
| 2,261,908 | A | 11/1941 | Waechter | |
| 4,988,229 | A | 1/1991 | Ramsey, III | |
| D327,172 | S * | 6/1992 | Pagano | D6/312 |
| 5,289,961 | A * | 3/1994 | Levitt et al. | 224/247 |
| 5,417,456 | A | 5/1995 | Laubacher | |
| 5,421,616 | A | 6/1995 | Laubacher | |
| 5,456,497 | A * | 10/1995 | Ross, Jr. | 281/42 |
| 6,186,464 | B1 | 2/2001 | Whitman | |
| 6,527,300 | B1 | 3/2003 | Moss | |
| 6,672,621 | B1 * | 1/2004 | Moss | 281/36 |
| 6,971,621 | B2 * | 12/2005 | Gaines | 248/447 |

FOREIGN PATENT DOCUMENTS

| | | |
|---|---|---|
| DE | 3108643 | 10/1982 |
| GB | 8189 | 4/1905 |

* cited by examiner

*Primary Examiner*—Amy J Sterling
*Assistant Examiner*—Steven Marsh
(74) *Attorney, Agent, or Firm*—Ryan Kromholz & Manion, S.C.

(57) ABSTRACT

A removably attachable manual support for a binder, folder or book and adaptable for outwardly extending, one-hand support of a binder and its contents when in use by soloists, choir members or lecturers. The manual support further includes an articulated rest structure for supporting the lower marginal edges of the spine and of each of the laterally extending cover panels of the binder or folder.

5 Claims, 2 Drawing Sheets

MANUAL SUPPORT FOR FOLDER OR BINDER AND CONTENTS THEREOF

BACKGROUND OF THE INVENTION

The present invention relates to a manual supporting device for a folder, notebook, binder, book, or the like, and more particularly relates to a removably attachable support for manually supporting a folder or book with one hand and for an extended period of time.

The present device finds particular application in connection with one-hand manual support of folders or binders containing sheet music for choir or choral groups, and for folders or binders holding lecture material. There has long been frustration among choir members or lectures when, in the absence of music stands or supporting lecturers, they are forced to stand and balance and hold music binders one hand outwardly extended for extended lengths of time. This is particularly true when the person suffers from even minor arthritis or other infirmity that may lead to cramping, or other painful affliction. In the case of three-ring, loose-leaf binders, the operating mechanism for support and operation of the retaining rings adds additional weight to the already heavy binder components.

There have been past efforts to provide manually supported binders, such as the folder holders disclosed in each of U.S. Pat. Nos. 5,417,456 and 5,421,616, each granted to Morgan K. Laubacher. Neither of these disclosures, nor other known prior art, would appear to disclose the added improvement of providing cooperating rest structures having articulately connected elements for individual support of a folder or binder having a spine and oppositely disposed, hingedly supported cover panels extending laterally relative to the spine.

SUMMARY OF THE INVENTION

The present invention provides both a novel detachable manual support for a folder or binder, as well as a novel rest support for material, such as loose leaf bound music or lecture sheets.

A preferred embodiment of the manual support includes a flat, relatively rigid, bar, or upright member, facing the outer surface of the spine of a binder or folder, and extending upwardly for a preselected distance from the lower marginal edge thereof. The distal end of the bar is preferably fastened to an extendable, elasticized, stretchable band having its opposite end fastened to a flattened, hook-like, member arranged for releasable attachment to the uppermost end of the folder or binder spine.

The outwardly facing surface of the rigid bar includes a flexible length of nylon strapping cooperating with the outwardly facing surface of the upright bar member to provide manual support means for receiving the hand of the singer or lecturer. The flexible hand strapping is of conventional nylon strapping with cauterized edges and forms a closed loop when fastened at opposite ends to the upright bar member. The loop may be conveniently sized to receive and conform to a single hand of a user holding the binder.

The rigid upright bar member is preferably pivotally attached to an articulated rest structure, the elements of which are each preferably formed from extruded flat stock, aluminum. The rest structure includes pivotally attached individual elongate elements, or sections, each having an L-shaped cross-section and being respectively arranged to accommodate the binder spine and each of the laterally extending back and front cover panels, in addition to music or other sheet materials contained therebetween. The bifurcated arms of each of the L-shaped extrusions include an inwardly extending base portion and an upwardly extending back portion cooperating to provide an integrally formed seat or rest at the lower marginal edge of each of the components of the folder or binder.

In addition, the base portion of each of the L-shaped components of the rest structure includes one or more upwardly bent picket portions which act as a barrier for resisting outward movement of respective binder components resting on and supported by the base portion.

DESCRIPTION OF THE PREFERRED EMBODIMENT

Figure 1:
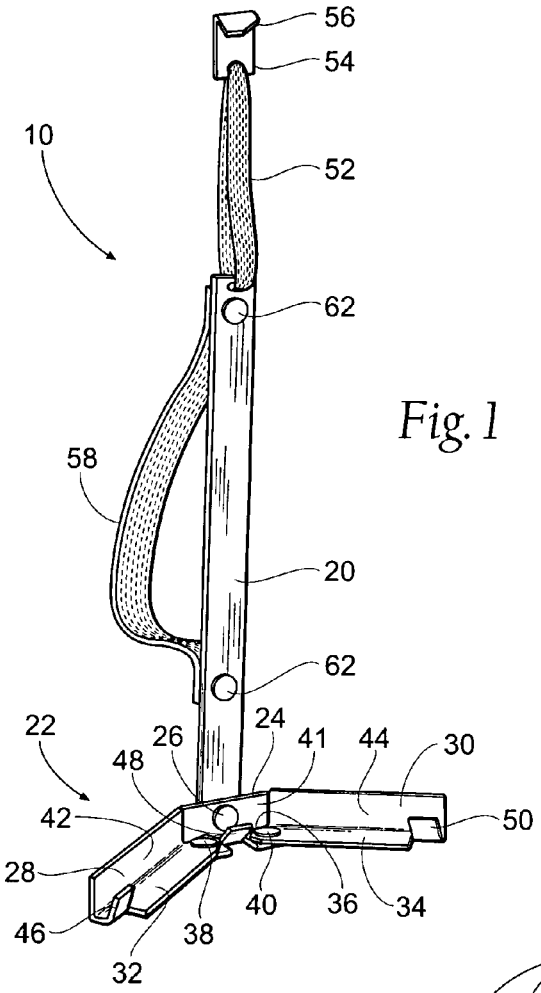
FIG. 1 is a perspective interior elevated view of the various assembled components of the manual support of this invention, including its preferred components arranged and assembled in accordance with the disclosure of the present invention, and ready to receive a binder or folder to be supported thereby.
Figure 2:
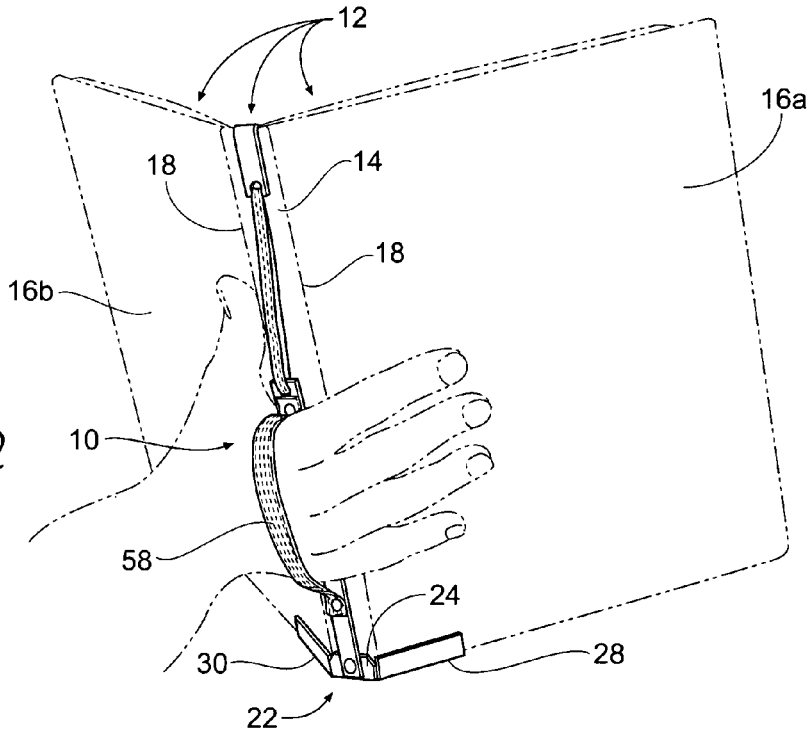
FIG. 2 is a perspective view illustrating the manual support illustrated in FIG. 1, and further disclosing the support in use with a binder (shown in phantom) and being held with one hand of singer or lecturer, and without need for further mechanical support, such as an upright lectern or conventional music stand.

As will be apparent from the various drawing FIGS. 1-4, inclusive, the manual support 10 of this invention may be readily attached to, or be detached from, a book or binder 12 (see FIG. 2) having an elongated spine 14 and laterally extending cover panels 16 hingedly sewn or otherwise hingedly attached to the side edge margins 18 of the spine 14.

Figure 3:
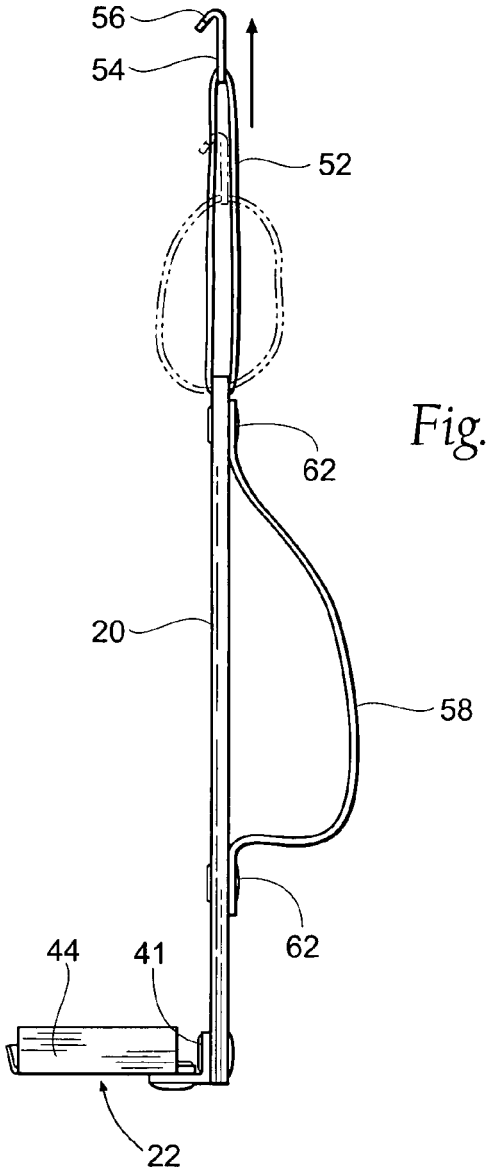
FIG. 3 is a side elevational view of the manual support illustrated in FIG. 1, and detached from a binder or folder to be supported thereby.
Figure 4:
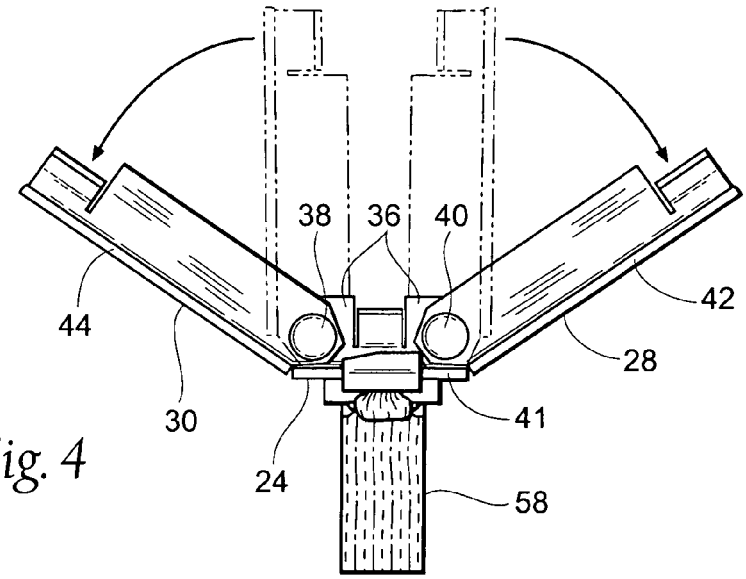
FIG. 4 is a top plan view of the support of FIG. 1, and showing the novel rest structure in extended support position and poised for retention of a binder or folder, and further illustrating, via phantom lines, the closed position of the rest structure being folded on its pivotal support to minimize overall size for ease in transporting the device to and from choral performances or lectures.

With particular reference to the views of FIG. 1, 3-4, inclusive, it will be observed that the support 10 is preferably assembled from several components, each being fabricated from a lightweight material such readily available 1/16 inch thick aluminum flat sheet stock. The manual support 10 includes an upright support member 20 fabricated from a preselected length of rigid, flat stock of aluminum sheet metal, which is readily available from home improvement stores. It is particularly convenient because of the relatively lightweight of the conventional 1/16 inch thick stock. The preferred width of the bar 20 is ½ inch, but this may be varied as desired by the fabricator of the device. It is also preferred to maintain the width of the supporting bar 20 to be less than the width of the spine 14. As shown, the bar 20 is fastened to an articulated rest structure 22 including a centrally located elongate rest element 24 extending crosswise relative to the bar 20 and being pivotally fastened by means of a rivet 26 to the lower end of the bar 20. The length of the rest element 24 is preferably chosen to provide adequate support to the spine portion 14 of the folder, binder or book. Also pivotally attached to the articulated rest structure 22 are oppositely disposed, laterally extending rest elements 28 and 30. The rest element 28 preferably supports the front cover panel 16*a*, whereas the oppositely ending rest element 30 is arranged to support the lower edge margin of the rear cover panel 16*b*. It will be apparent that the centrally located rest element 24 is intended to provide support of the lower marginal edge of the spine 14. Each of the elements 24, 28 and 30 are formed with an L-shaped cross section to provide inwardly extending base portions 36, 32 and 34, respectively, and with upstanding back portions 41, 42 and 44, respectively.

It will be further noted that base portions 32 and 34 of the laterally extending elements 28 and 30 overly base portion 36 of the centrally located element 24, and further are pivotally attached to a respective base portion 36 of the element 24 by means of rivets 38 and 40, respectively. This overlying or overlapping arrangement of the elements 28 and 30 with respect to the element 24 provides freedom in outward rotation of each of the elements 28 and 30 with respect to the supporting central element 24. With particular reference to FIG. 4, it will be noted that the laterally extending rest elements 28 and 30 may be rotated on their pivoting supporting rivets 38 and 40, respectively, to a position favored by the user of the binder and of the present supporting device 10. It will be apparent that the pivoted ends of the elements 28 and 30 may be arcuately or otherwise formed to permit the elements to be estopped from further movement by contact of the upstanding back portions 42 and 44 of the respective laterally extending elements 28 and 30. Portions of the structure may be cut away to allow for further freedom of motion, or for estopped of motion beyond a certain designated position.

It will also be noted that each of the elements 26, 28 and 30 are slit on the respective base portions to provide a means of upwardly bending tabbed areas 46, 48 and 50 for retention of the cover panels 16*a* and 16*b* and the spine 14 in the respective articulated rest elements 26, 28 and 30. These tabs 46, 48 and 50 act to restrain the respective cover panels 16*a* and 16*b* and spine 14 from lateral movement outwardly relative to the upright supporting bar member 20.

As stated previously, the manual support 10 is preferably made to be removably attachable with respect to a binder, and as such, the support 10 is provided with the bar member 20 being of a predetermined length and attachable at its distal end portion to a longitudinally extendable, elasticized biasing element 52 having its opposite end attached to a hook-like fastener 54 having an overhang portion 56. The portion 56 is longitudinally moved against the bias of the extendable member 52 to grasp the top marginal edge of the spine 14.

With particular reference to the view of FIG. 3, it is to be noted that the elasticized, extendable biasing element 52, also shown in phantom on FIG. 3, may be stretched against its inherent bias to provide longitudinal movement upwardly of the hook 54 for releasable fastening to the upper marginal edge of the spine 14.

Further with regard to the views of FIGS. 1 and 3, it will be noted that the hand support 58, made of conventional strapping material, is formed as a continuous, closed loop dimensioned to receive the contour of the hand by simply positioning opposite ends of a given length of the flexible strapping material being fastened to the upright bar supporting member 20. This is accomplished by using longitudinally spaced, rivets 62 inserted in longitudinally spaced predrilled apertures (not specifically shown) in the upright bar member 20. It will be further noted that predrilled openings or slotted opening may be provided, though also not shown, for receiving conventional nut and screw fasteners if circumstances permit. The main thing is that a loop may be formed by cooperation of the upright bar 20 and the flexible strap hand support 58 to receive and conform to the middorsal fascial surface of the human hand supporting the binder 12. As disclosed herein, an adjustable feature is not used in this preferred embodiment, but the dimensions are preselected to receive a particular sized hand, just as gloves are fitted by size to a hand. It is also preferred to mount the flexible nylon strapping to a position on the upright bar 20 located just below the center of gravity of the binder and its contents as an additional means of comfortable support of the folder or binder.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A removably attachable manual support for a binder, said binder having a spine with an exterior surface including an upper marginal edge, a lower marginal edge and a pair of parallel, laterally spaced, marginal side edges, each of said marginal side edges respectfully hingedly supporting a laterally extending cover panel, said manual support comprising:

an elongate supporting, relatively rigid, upright member located adjacent to the exterior surface of said spine and extending upwardly for a preselected distance measured from the lower marginal edge of said spine, and having a distal end spaced a predetermined distance from the upper marginal edge of said spine;

an articulated rest structure comprising a centrally located, L-shaped rest element for resting support of said spine, said centrally located rest element being attached to the lower end portion of said supporting upright member and extending crosswise of said spine, and a pair of L-shaped extension rest elements, each being pivotally attached to and extending laterally from oppositely located distal end portions of said centrally located rest element for resting support of a respective cover panel, each of said rest elements of said rest structure having a substantially identical L-shaped cross-section, said cross-section being formed from relatively flat sheet stock configured to include a relatively flat base portion respectively extending inwardly from said resting binder spine and said cover panels and a relatively flat, integrally formed, back portion extending upwardly from said base portion;

a longitudinally extendable, elasticized biasing element attached to the free end of said elongate supporting upright member and being extendable to span only the remaining distance measured between said distal end of said rigid upright member and said upper marginal edge of said spine;

a hand-receiving, supporting loop comprising a flexible strap of material extending longitudinally of said rigid supporting upright member, said flexible strap having each of its opposite end portions being respectively secured to said upright member and cooperating with the exterior surface of said upright member to form a closed loop of preselected dimension to receive, grasp and comfortably conform to the middorsal fascial surface area of the supporting hand of a user of said binder; and releasable fastening means for attaching said extendable elasticized biasing element to said upper marginal edge of said spine.

2. The manual support of claim 1 wherein the elements comprising the L-shaped rest structure are formed from relatively thin sheet material, and wherein the base portion of each element includes a portion of its length being bent upwardly for restriction of lateral outward movement of the respective binder spine or cover panel resting thereon.

3. The manual support of claim 1 wherein said releasable fastening means comprises a hook-shaped member having one end anchored to said lengthwise extensible element and having its free end being bent to reasonably receive the upper margin of said spine.

4. The manual support of claim 1 wherein the upstanding back portion of said centrally located rest element is pivotally attached to the lower end portion of said upright member.

5. The manual support of claim 1 wherein each of the base portions of said laterally extending rest elements have their respective proximal end portions each overlying the upper surface of the base portion of said central rest element.

* * * * *